United States Patent [19]

Atkinson

[11] Patent Number: 4,632,768

[45] Date of Patent: Dec. 30, 1986

[54] CLAY FABRIC SOFTENER AGGLOMERATES

[75] Inventor: Neil J. Atkinson, Brussels, Belgium

[73] Assignee: The Procter & Gamble Company, Cincinnati, Ohio

[21] Appl. No.: 741,761

[22] Filed: Jun. 6, 1985

[30] Foreign Application Priority Data

Jun. 11, 1984 [GB] United Kingdom ..... 8414877

[51] Int. Cl.[4] ..... D06M 11/00; D06M 11/06; D06M 13/46; C11D 3/12

[52] U.S. Cl. ..... 252/8.8; 23/313 R; 23/313 AS; 252/8.6; 252/8.9; 252/131; 252/140; 252/155; 252/174.25; 252/528; 252/547

[58] Field of Search ..... 252/8.6, 8.8, 131, 140, 252/155, 174.25, 547, 528

[56] References Cited

U.S. PATENT DOCUMENTS

| | | | |
|---|---|---|---|
| 3,529,923 | 9/1970 | Perry | 8/77 |
| 3,862,058 | 1/1975 | Nirschl et al. | 252/528 |
| 3,936,537 | 2/1976 | Baskerville et al. | 427/242 |
| 4,419,250 | 12/1983 | Allen | 252/8.6 |
| 4,472,287 | 9/1984 | Ramachandran | 252/8.7 |
| 4,488,972 | 12/1984 | Weinstein | 252/8.6 |

*Primary Examiner*—Dennis L. Albrecht

*Attorney, Agent, or Firm*—Robert B. Aylor; Richard C. Witte; Thomas H. O'Flaherty

[57] ABSTRACT

Granular laundry detergent compositions containing swellable clays as fabric softener ingredients can clog dispensers in automatic washing machines. By the present invention, the softener clays are formed into agglomerates and coated with a dispensing aid to overcome this problem. Water-soluble quaternary ammonium compounds are preferred dispensing aids; fully-formulated laundry detergents are disclosed.

4 Claims, No Drawings

CLAY FABRIC SOFTENER AGGLOMERATES

TECHNICAL FIELD

The present invention relates to clays of the type currently used in detergent compositions, and the like, to provide a fabric softening function. Some detergent compositions contain the clay softener in the form of small, granular agglomerates. Unfortunately, such clay agglomerates can undesirably affect the dispensability of the detergent compositions from dispensers commonly employed in automatic washing machines. The present invention provides means for overcoming this difficulty.

BACKGROUND

Various patent documents describe granular detergent compositions comprising particulate materials such as fabric softener clays and builder zeolites, together with various fabric treating agents such as long-chain organic amines and quaternary ammonium compounds. See, for example: German 29 64 114.3; EPO 80200570.2; 80200877.1; 80201015.7 and German 28 57 163.3; 24 39 541.3 and 23 34899.4. Many such products are prepared by mixing the clay with the crutcher mix and spray-drying, in well-known fashion.

In some instances, the formulator of such clay-containing detergents may wish to add clay to the product by a simple dry-mixing operation, whereby agglomerated clay is simply admixed with a spray-dried "base" detergent powder. Indeed, agglomerated clays are available from many commercial sources as generally spherical particles, usually approximately 0.2–6 mm in diameter. Such agglomerates may be dyed various colors to signal their presence in the detergent composition. However, on contact with water the clay agglomerates can impede release of the detergent granules from automatic washing machine detergent dispensers.

This dispensing problem has now been overcome, as will be seem from the following disclosure.

SUMMARY OF THE INVENTION

The present invention encompasses agglomerates comprising fabric softener clays (especially smectite clays) said agglomerates comprising an effective amount of a dispensing aid on their surfaces.

The invention also encompasses granular detergent compositions which comprise various conventional detersive ingredients such as detersive surfactants, builders, enzymes, bleach, optical brighteners, bleach activators and the like, all at conventional levels, as well as various water-insoluble particulate ingredients such as zeolites and fabric softener clays, characterized in that fabric softener clay is in the form of agglomerates, said agglomerates being substantially coated with a dispensing aid.

All percentages and ratios recited herein are by weight, unless otherwise stated.

DETAILED DESCRIPTION OF THE INVENTION

As noted, the compositions of this invention comprise, in major part, conventional ingredients that are quite familiar to formulators of granular detergents. One of the major advantages of the dispensing aids used in this invention is that they are entirely compatible with such conventional detergent ingredients, used at conventional concentrations.

Softener Clay: Clay softeners used herein are well-known in the detergency patent literature and are in broad commercial use, both in Europe and in the United States. Included among such clay softeners are various heat-treated kaolins and various multi-layer smectites. Preferred clay softeners are smectite softener clays that are described in German patent document 2 334 899 and in U.K. Pat. No. 1 400 898, which can be referred to for details. Softener clays are used in the preferred compositions at levels of at least 1%, generally 1–20%, preferably 2–7%. As known from the art, preferred smectite clay softeners exhibit an ion-exchange capacity of at least 50 meq ($Ca^{++}$ as $CaCO_3$) per 100 grams of clay, generally 70 meq/100 g, and greater, and are impalpable (particle size in the 5–50 micron range).

Specific non-limiting examples of such fabric softening smectite clay minerals available from commercial sources under the following listed names are:

Sodium Montmorillonite

Borck
Volclay BC
Gelwhite GP p1 Thixo-Jel #
Ben-A-Gel

Sodium Hectorite

Veegum F
Laponite SP

Sodium Saponite

Barasym NAS 100

Calcium Montmorillonite

Soft Clark
Gelwhite L
Imvite K

Lithium Hectorite

Barasym LIH 200

Clay Agglomerates: The above-disclosed, small particle size clay is used in the practice of this invention in the form of generally spherical agglomerates, generally of a diameter in the range of 0.2–3 mm. The manufacture of the clay agglomerates per se is not part of the present invention. Indeed, clay agglomerates are available commercially and can be prepared by various art disclosed methods using various binder materials such as sulfate, silicate, or even water. In general, the particulate clay is mixed with the binder, agitated in any suitable apparatus, such as a conventional pan agglomerator, and dried, whereby the particles adhere to one another as agglomerates. Water agglomerates are preferred in the practice of this invention.

Dispensing Aid: Detergent dispensers of the type found in automatic washing machines function best if the detergent granules are flushed thereform by incoming wash water in the form of generally intact granules. If the detergent granules begin to dissolve in the dispenser, they can form mesophase materials which are viscous, thereby clogging the dispenser. Since clays, themselves, are swellable materials, they can contribute to the clogging problem.

The dispensing aids herein are designed to impede clay swellability sufficiently to allow the clay agglomerates to survive their time in the dispenser relatively intact, yet not be so tenaciously affixed to the agglomerates as to decrease their ability to break-apart in the wash liquor and function as a fabric softener.

The most preferred dispensing aids herein are the well-known water-soluble quaternary ammonium salts of the general formula $R_1R_2R_3R_4N^+X^-$ wherein $R_1$ is $C_8$–$C_{20}$, preferably $C_{12}$–$C_{18}$, alkyl, and $R_2$,$R_3$ and $R_4$ are each short-chain ($C_1$–$C_4$) alkyl or substituted alkyl, and X is an anion such as chloride, bromide or methosulphate. Monococonutalkyl trimethyl ammonium bromide and monotallowalkyl trimethyl ammonium chloride are typical examples of such preferred dispensing aids.

Other dispensing aids herein are the substantially water-insoluble quaternaries of the formula $R_1R_2R_3R_4N^+X^-$, wherein both $R_1$ and $R_2$ are $C_8$–$C_{20}$, preferably $C_8$–$C_{18}$, and $R_2$, $R_3$ and X are as mentioned above. A typical example of such material is ditallowalkyl dimethyl ammonium chloride.

Mono- and Di- and tri-amines of the formula $R_1R_2R_3N$, wherein at least $R_1$ is $C_8$–$C_{20}$ alkyl, and wherein $R_2$ and $R_3$ each may be Hydrogen or $C_1$–$C_{20}$ alkyl, can be used as dispensing aids herein. Dicoconutalkylmethyl amine, monococonutalkyl methyl amine and monococonutalkyl amine are representative examples of such materials.

Other dispensing aids which can be coated onto the clay agglomerates include: fatty acid mixtures; fatty acid esters; sorbitan esters of fatty acids; carnauba waxes; polyalkylene glycols, and the like, all of which provide a slight, but sufficient, binding/coating action that allows the agglomerates to survive the initial influx of water into the detergent dispenser.

It is to be understood that the water-soluble quaternaries are much preferred for use as dispensing aids herein.

Conventional Ingredients—Apart from the dispensing aids described hereinabove, the detergent compositions of this invention comprise various conventional ingredients such as detersive surfactants, and adjuncts such as detersive enzymes, bleaches, bleach activators, detergency builders and the like, all well-known in the art and in commercial practice. Low-phosphorus compositions can be prepared using zeolite builders.

Detersive Surfactants—The compositions of this invention will typically contain organic surface-active agents ("surfactants") to provide the usual cleaning benefits associated with the use of such materials.

Detersive surfactants useful herein include well-known synthetic anionic, nonionic, amphoteric and zwitterionic surfactants. Typical of these are the alkyl benzene sulfonates, alkyl- and alkylether sulfates, paraffin sulfonates, olefin sulfonates, alkoxylated (especially ethoxylated) alcohols and alkyl phenols, amine oxides, α-sulfonates of fatty acids and of fatty acid esters, and the like, which are well-known from the detergency art. In general, such detersive surfactants contain an alkyl group in the $C_9$–$C_{18}$ range; the anionic detersive surfactants can be used in the form of their sodium, potassium or triethanolammonium salts; the nonionics generally contain from about 5 to about 17 ethylene oxide groups. U.S. Pat. Nos. 4,111,855 and 3,995,669 contain detailed listings of such typical detersive surfactants. $C_{11}$–$C_{16}$ alkyl benzene sulfonates, $C_{12}$–$C_{18}$ paraffin-sulfonates and alkyl sulfates, and the ethoxylated alcohols and alkyl phenols are especially preferred in the compositions of the present type.

Also useful herein as the surfactant are the water-soluble soaps, e.g. the common sodium and potassium coconut or tallow soaps well-known in the art.

The surfactant component can comprise as little as 1% of the compositions herein, but preferably the compositions will contain 5% to 40%, preferably 10% to 30%, of surfactant. Mixtures of anionics such as the alkyl benzene sulfonates, alkyl sulfates and paraffin sulfonates are preferred for through-the-wash cleansing of a broad spectrum of soils and stains from fabrics.

Detersive Adjuncts—The compositions herein can contain other ingredients which aid in their cleaning performance. For example, it is highly preferred that through-the-wash detergent compositions contain a detergent builder and/or metal ion sequestrant. Compounds classifiable and well-known in the art as detergent builders include the nitrilotriacetates, polycarboxylates, citrates, water-soluble phosphates such as tri-polyphosphate and sodium ortho- and pyro-phosphates, silicates, and mixtures thereof. Metal ion sequestrants include all of the above, plus materials like ethylenediaminetetraacetate, the amino-polyphosphonates and phosphates (DEQUEST) and a wide variety of other poly-functional organic acids and salts too numerous to mention in detail here. See U.S. Pat. No. 3,579,454 for typical examples of the use of such materials in various cleaning compositions. In general, the builder/sequestrant will comprise about 0.5% to 45% of the compositions. The 1–10 micron size zeolite (e.g. zeolite A) builders disclosed in German Pat. No. 2 422 655 are especially preferred for use in low-phosphate compositions.

The laundry compositions herein also preferably contain enzymes to enhance their through-the-wash cleaning performance on a variety of soils and stains. Amylase and protease enzymes suitable for use in detergents are well-known in the art and in commercially available liquid and granular detergents. Commercial detersive enzymes (preferably a mixtures of amylase and protease) are typically used at levels of 0.001% to 2%, and higher, in the present compositions.

Moreover, the compositions herein can contain, in addition to ingredients already mentioned, various other optional ingredients typically used in commercial products to provide aesthetic or additional product performance benefits. Typical ingredients include pH regulants, perfumes, dyes, bleach, optical brighteners, soil suspending agents, bactericides, preservatives, suds control agents, and the like. Such ingredients typically comprise 0.5% to 30% of conventional, granular laundry detergents.

The compositions herein can also contain additional quantities of the aforementioned amine or quaternary compounds, over and above that coated onto the clay agglomerates, to function as auxiliary softening agents for the clay. In general, for such auxiliary softening use the detergent compositions herein will contain from 0.5% to 15% of these agents, over and above what is on the agglomerates. See, for example, EPO 80 200 877.1 for a further description of such materials and their use as softeners in clay-containing granular detergents.

In a through-the-wash mode, the compositions prepared in the manner of this invention are typically used at a concentration of at least 500 ppm, preferably 0.10% to 1.5%, in an aqueous laundry bath at pH 7–11 to launder fabrics. The laundering can be carried out over the range from 5° C. to the boil, with excellent cleaning-/softening results and without dispenser clogging.

INDUSTRIAL APPLICATION

Stated generally, the fully formulated detergent compositions herein are in granular form, and comprise:

(i) at least 1%, typically 5–40%, conventional detersive surfactant;

(ii) at least 1%, typically 1–20%, softener clay as agglomerates, said agglomerates being substantially coated with a dispensing aid;

(iii) 0.5%–45% detergency builder;

(iv) optionally (typically 0.001–2%) enzymes; and (v) optionally, conventional detersive adjuncts such as sodium perborate bleach, perborate activators, optical brighteners, and the like, at conventional levels.

In a highly preferred mode, the compositions will also contain 0.1% to 15% one or more of the amine and/or cationic fabric softener adjuncts (described in EPO 80 200 877.1), as part of the "base" granule.

The compositions herein are prepared by separately forming the clay agglomerate coated with the dispensing aid and the detergent "base" granule, and then simply dry-mixing the two. In a commercial process, the coating of dispensing aid will not usually completely cover each agglomerate, and, indeed, perfect coating is not necessary to the successful practice of the invention; "substantially" coating the agglomerates will suffice.

The base granules can be formed from an aqueous crutcher mix by any of a number of well-known processes, but conventional spray-drying is convenient.

The coating of dispensing aid can be applied to the clay agglomerates in any number of ways, but simple spraying thereon is convenient. In a preferred mode, a water solution/dispersion of the above-discribed water-soluble quaternaries is sprayed onto the agglomerates and dried.

One of the advantages of the present invention is that it can be performed using conventional procedures and apparatus known in the detergency arts.

The following examples are typical of compositions prepared according to this invention, but are not intended to be limiting thereof.

EXAMPLE I

A. Preparation of Clay: A commercial smectite softener clay is admixed with 20% its own weight of water and agglomerated into particles in the size range 3–4 mm in a standard pan agglomerator.

A saturated aqueous solution of tallow alkyl trimethyl ammonium chloride is sprayed evenly onto the clay agglomerates, and dried to form a more-or-less complete coating on the agglomerate particles. The quat (TTAC) coating represents about 0.1–3% of the weight of the clay agglomerates.

B. Preparation of Base Detergent Granule: A spray-dried detergent granule is prepared as follows.

An aqueous crutcher mix comprising the following ingredients is prepared (percentages listed relate to percent ingredients in the complete formulation after spray-drying and mixing with the clay agglomerates) and spray-dried in a standard tower to form base granules,

| Ingredients | Percent |
|---|---|
| $C_{11-12}$ alkyl benzene sulfonate | 6.2 |
| Sodium perborate*** | 20.0 |
| Sodium tripolyphosphate | 24.0 |
| Sodium sulfate | 22.0 |

-continued

| Ingredients | Percent |
|---|---|
| Sodium silicate | 8.0 |
| Ditallow methyl amine | 3.8 |
| Carboxymethyl cellulose | 0.4 |
| Enzymes*** | 0.5 |
| Optical brightener | 0.23 |
| Sulphonated zinc phthalocyanine** | 25 ppm |
| EDTA | 0.2 |
| Perfume/copper salts/minors | 0.5 |
| Moisture | to 100 |

*Natural smectite; ion-exchange capacity above 50 meq/100 g clay
**U.S. Pat. No. 3.927.967.
***Dry-mixed with granule after spray-drying The coated clay agglomerates are then uniformly dry-mixed with the base granules at a level of 2.5% of the finished formulation.

In use, the composition of Example I is cleanly dispensed from the dispenser receptacle of an automatic clothes washing machine.

EXAMPLE II

A highly preferred spray-dried granule which contains a mixed softener active comprising clay/amine/-quaternary is prepared as follows:

| INGREDIENT | PERCENT |
|---|---|
| $C_{11-12}$ Alkyl Benzene Sulfonate (Na) | 6 |
| Sodium Tripolyphosphate | 12 |
| Zeolite A (1–10 micron) | 12 |
| Silicate Solids | 8 |
| Sodium Sulphate | 23 |
| Sodium Perborate (anhydrous)** | 10 |
| Tetraacetyl Ethylene Diamine | 1.0 |
| Smectite Clay* | 2.4 |
| Tetradecyl Trimethyl Ammonium Chloride | 2 |
| Ditallow Methyl Amine | 4 |
| Sodium Toluene Sulfonate | 0.6 |
| Protease Enzyme** | 0.5 |
| CMC/Soil Release Polymers | 2 |
| Brightener/Perfume**/Minors | 2 |
| Moisture | balance |

*As coated agglomerates per Example I and dry-mixed with the balance of the base granules after spray-drying.
**The indicated ingredients are mixed with the granules after spray-drying.

I claim:

1. A clay fabric softener consisting essentially of clay particles in the form of agglomerates, said agglomerates being substantially coated with from about 0.1 to about 3% of a dispensing aid selected from the group consisting of: water-soluble quaternary ammonium salts of the general formula $R_1R_2R_3R_4N^+X^-$ wherein $R_1$ is $C_8$–$C_{20}$ alkyl and $R_2$, $R_3$ and $R_4$ are each $C_1$–$C_4$ short-chain alkyl and X is an anion and mixtures thereof which provide a slight but sufficient binding/coating action to allow the agglomerates to survive the initial influx of water in a detergent dispenser.

2. A granular detergent composition comprising detersive surfactants, characterized in that it contains from 1–20% by weight of clay softener in the form of agglomerates according to claim 1.

3. A detergent composition according to claim 2 which additionally comprises a detergency builder.

4. A detergent composition according to claim 3, comprising:

(i) at least 1% detersive surfactant;

(ii) at least 1% softener clay in the form of said agglomerates;

(iii) 0.5%–45% detergency builder;

(iv) 0.001–2% enzymes; and (v) detersive adjuncts selected from the group consisting of sodium perborate bleach, perborate activators, optical brighteners, and mixtures thereof.

* * * * *